US007730837B2

(12) United States Patent
Lahitte et al.

(10) Patent No.: US 7,730,837 B2
(45) Date of Patent: Jun. 8, 2010

(54) INITIATOR INCLUDING A ZONE OF WEAKNESS

(75) Inventors: Stéphane Lahitte, Chaumontel (FR); Yann Decaesteker, Senlis (FR); Adélino Carrol, Viarmes (FR)

(73) Assignee: Autoliv Development AB, Vargarda (SE)

( * ) Notice: Subject to any disclaimer, the term of this patent is extended or adjusted under 35 U.S.C. 154(b) by 384 days.

(21) Appl. No.: 11/664,779

(22) PCT Filed: Oct. 19, 2005

(86) PCT No.: PCT/EP2005/055371

§ 371 (c)(1),
(2), (4) Date: Apr. 5, 2007

(87) PCT Pub. No.: WO2006/045726

PCT Pub. Date: May 4, 2006

(65) Prior Publication Data

US 2007/0261582 A1 Nov. 15, 2007

(30) Foreign Application Priority Data

Oct. 21, 2004 (FR) ..... 04 11206

(51) Int. Cl.
*F42B 3/10* (2006.01)

(52) U.S. Cl. ..... 102/202.12; 102/202.5; 102/530

(58) Field of Classification Search ..... 102/202.5, 102/202.12, 530
See application file for complete search history.

(56) References Cited

U.S. PATENT DOCUMENTS

| | | | | |
|---|---|---|---|---|
| 5,005,486 | A * | 4/1991 | Lenzen | 102/531 |
| 5,423,261 | A | 6/1995 | Bernardy et al. | |
| 5,601,308 | A * | 2/1997 | Cuevas | 280/736 |
| 6,338,500 | B1 * | 1/2002 | Perotto | 280/741 |
| 2003/0177936 | A1 | 9/2003 | Luebbers | |
| 2004/0107856 | A1 | 6/2004 | Hennings et al. | |

FOREIGN PATENT DOCUMENTS

| | | |
|---|---|---|
| FR | 2 852 388 | 9/2004 |
| WO | WO 02/08028 A1 | 1/2002 |
| WO | WO 02/073117 A1 | 9/2002 |

* cited by examiner

*Primary Examiner*—Bret Hayes
*Assistant Examiner*—Michael D David
(74) *Attorney, Agent, or Firm*—Brinks Hofer Gilson & Lione

(57) ABSTRACT

The present invention relates to an electropyrotechnic initiator comprising: an ignition support (10); an electrical initiation system (11) connecting the ignition support (10) to a source of electricity; and a cap (2) containing at least one explosive composition, the cap being of generally cylindrical shape presenting an open first end (20) connected to the ignition support (10), an opposite second end that is closed by an end wall (21), and a peripheral side wall (22) which presents at least one zone of weakness (3). This initiator is essentially remarkable in that at least one of the zones of weakness extends along a non-closed trace and over a portion only of the side wall (22), i.e. without reaching its opposite ends.

8 Claims, 2 Drawing Sheets

INITIATOR INCLUDING A ZONE OF WEAKNESS

CROSS-REFERENCE TO RELATED APPLICATION

This application is a 371 U.S. National Stage of International Application No. PCT/EP2005/055371, filed Oct. 19, 2005, published in English as WO 2006/045726 A1 on May 4, 2006. This application claims the benefit of French Application No. 0411206, filed Oct. 21, 2004. The disclosure(s) of the above applications is incorporated herein by reference.

FIELD OF THE INVENTION

The present invention relates to an electropyrotechnic initiator.

The invention thus lies in the field of motor vehicle safety.

BACKGROUND OF THE INVENTION

The electropyrotechnic initiators integrated in gas generators traditionally comprise an ignition support, and electrical initiation system connecting the ignition support to a source of electricity, and a fragmentable cap containing at least one electropyrotechnic composition.

This case-forming cap, usually made of metal, is held inside the generator by mechanical fastening and connection means. It is sealed and isolated from the outside.

In operation, the pressure rises inside the cap and the cap opens in its weakest zone, thereby releasing a flame and hot gases which, in turn, initiate an electropyrotechnic material present in the generator, such as a propellant, suitable for generating gas.

The zone of weakness is generally created by rupture-starters, which are obtained by stamping indented patterns, in particular when the case is made by stamping.

Said cap is generally cylindrical in shape, presenting an open first end connected to the ignition support, an opposite second end closed by an end wall, and a cylindrical side wall.

Until now, many initiators have presented rupture-starters in the end wall, thereby allowing the flame to exit axially.

Nevertheless, certain generators, in particular those having a mass of propellant in the form of a ring surrounding the initiator, or in which the electropyrotechnic charge is so small that rupturing the axial end wall would run the risk of damaging the charge, operate under better conditions when the flame exits radially, i.e. through the side wall of the cap, via holes that are closed while not in operation by an inside wall of plastics material.

Other structures allow the flame to exit radially.

Thus, U.S. Pat. No. 5,005,486 (Lenzen) describes a gas generator which includes an initiator whose side wall has zones of weakness disposed parallel to the generator lines of the cylinder in which the cap of the initiator is defined. Those zones extend from one end of the cap to the other.

In practice, when the zones of weakness give way, the initiator opens up completely to such an extent that the integrity of its structure is affected.

Another structure described in U.S. Pat. No. 5,601,308 (Cuevas).

In that case, the zone of weakness forms a circumferential line going round the side wall of the cap of the initiator.

In that case also, the integrity of the initiator is affected, since after the zone of weakness has ruptured, one complete portion of the initiator becomes detached from the remainder.

Complete rupture of the initiator can allow particles to escape, in particular metal particles, that run the risk of being expelled to the outside.

An object of the present invention is to solve those problems by proposing specifically an initiator in which the (cylindrical) peripheral side wall of the cap presents a zone of weakness, but conserves its integrity, even after said zone has ruptured.

Another aim of the invention is to achieve the above-specified object without significantly changing the usual "architecture" of the initiator.

The invention thus provides an electropyrotechnic initiator which comprises:

- an ignition support;
- an electrical initiation system connecting the ignition support to a source of electricity; and
- a cap containing at least one explosive composition, the cap being of generally cylindrical shape presenting an open first end connected to the ignition support, an opposite second end that is closed by an end wall, and a peripheral side wall which presents at least one zone of weakness.

According to the invention, at least one of the zones of weakness extends along a non-closed trace and over a portion only of the side wall, i.e. without reaching its opposite ends.

The term "non-closed trace" is used to mean that the trace presents at least two distinct ends that do not coincide.

By means of the particular configuration of said trace, there is no rupturing of the initiator into a plurality of distinct and separate pieces. It conserves its integrity without affecting the immediate surroundings.

In another embodiment of the invention, the non-closed trace is shaped in such a manner that after each zone of weakness has opened, a fragment of the wall situated between two adjacent ends of the trace remains attached to the wall.

This wall fragment or "petal" remains attached to the wall of the initiator, without any risk of damaging the surrounding component, and it can act as a deflector for channeling the flame and the gas.

According to other, non-limiting characteristics:

- the trace is cruciform;
- the trace is in the form of a Saint Andrew's cross;
- the trace is of curved shape;
- the trace is in the form of a circular arc;
- the trace is horseshoe-shaped;
- that each zone of weakness is constituted by a thinning of material; and
- each zone of weakness is obtained by stamping.

Other characteristics and advantages of the present invention appear on reading the following detailed description made with reference to the accompanying drawings, in which:

DETAILED DESCRIPTION OF INVENTION

Figure 1:
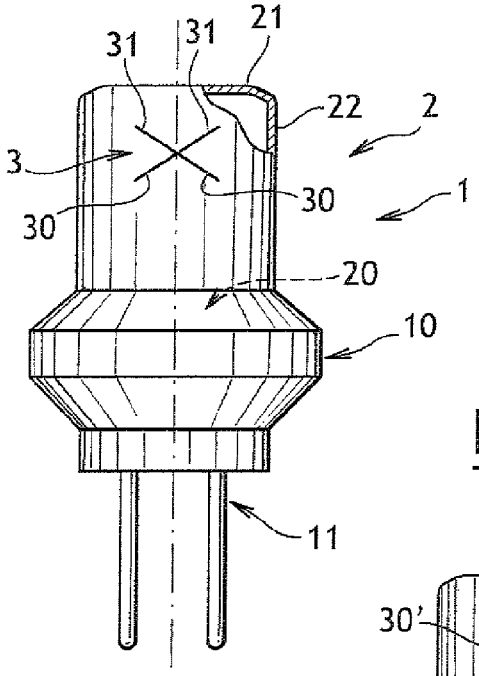
FIGS. 1 to 3 are three side views of three possible embodiments of the initiator.
Figure 3:
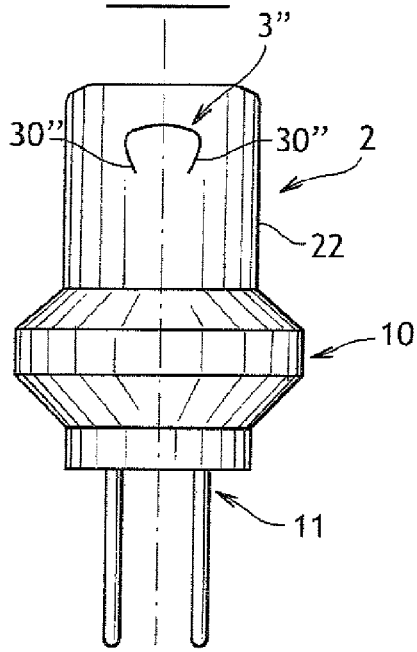
Figure 2:
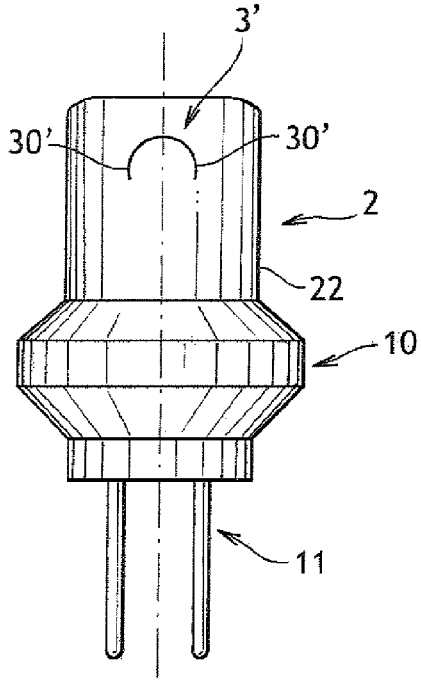

The structure of the forms of the initiator 1 shown in FIGS. 1 to 3 is itself known.

Such an initiator 1 comprises an ignition support 10 (not shown but integrated within a projecting molding).

It also comprises an initiation system enabling the initiator 1 to be connected to a source of electricity (not shown) which system consists in a pair of metal pins 11 embedded in the ignition support 10 and having their bottom ends extending from the projecting molding.

Finally, the ignition support 10 communicates with a cap 2 of essentially cylindrical shape via an open first end 20.

Its second end, opposite from the first 20, is closed and constitutes an end wall 21.

Finally, the cap 2 has a peripheral side wall 22 which defines a cylinder.

The cap 2 is preferably made of metal by the stamping technique.

It contains at least one explosive composition suitable for being initiated by the ignition support 10 and for producing a flame and gas that are directed to the outside via the cap 2.

In accordance with the invention, this direction takes place through said peripheral side wall 22 which, for this purpose, presents at least one zone of weakness 3, or 3' or 3".

This zone of weakness extends along a non-closed trace and over a portion only of said side wall 22, i.e. without reaching its opposite ends.

Thus, with reference to FIG. 1, the zone 3 has a cruciform trace, and more precisely it is in the form of a Saint Andrew's cross.

It is constituted by thinning the material constituting the wall 22, with this being done by clamping, for example.

This trace is constituted by two lines 30 which cross substantially on a longitudinal midplane of the initiator 1, each line presenting opposite ends 31.

The zones 3' and 3" of the initiators in FIGS. 2 and 3 present traces of curved shape.

The trace 3' is constituted by a circular arc having two opposite ends 30'.

The trace 3" is horseshoe-shaped, which means that its opposite ends 30" are spaced apart by a distance that is smaller than its greatest width.

Only one zone of weakness is shown per initiator. Nevertheless, the number of zones could be greater, for example it could be equal to two or three. Under such circumstances, the zones should be spread out angularly in regular manner around the wall 22.

The zone of weakness is situated axially not far from the end wall 21. Naturally, it could be offset, so as to be closer to the ignition support end.

In addition, the zone of weakness is of an extent that is small compared with the area of the wall 22. This extent may be increased depending on needs, in particular in order to increase the flow of flame and gas after the initiator has been operated.

As stated above, initiating the explosive composition inside the initiator 1 causes its internal pressure to rise, such that the zone of weakness opens along said trace, thereby releasing the flame and gas.

Because the trace is not closed and extends over only a portion of said side wall 22, i.e. without reaching the opposite ends of the cap 2 (in other words without connecting the opening 20 to the end wall), the opening remains local, and the cap 2 is not destroyed. The opening is limited to the zone of weakness.

The shape of the cap 2 remains unchanged, and no part of it becomes detached from the remainder of the device. In other words, its integrity is unaffected.

The three embodiments shown in FIGS. 1 to 3 have in common the fact that said trace is shaped in such a manner that after the zone of weakness 3, 3', or 3" has opened, the fragment F of wall 22 that is situated between the two adjacent ends of said trace remains attached to said wall.

Figure 4:
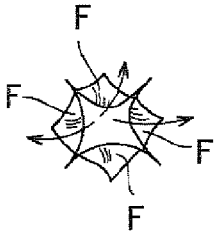
FIGS. 4 to 6 are simplified diagrams comprising face views of the opening generated in the wall of the initiator, after the zone of weakness has opened.

Thus, as shown in FIG. 4, the zone of weakness 3 opens along the cruciform trace of FIG. 1, so that four fragments or "petals" F remain attached to the wall 22 of the initiator 1.

Figure 5:
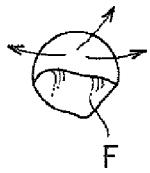
Figure 6:
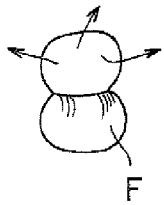

The embodiments of FIGS. 5 and 6, because of the zones of weakness 3' or 30" have only two opposite ends 30' or 30", only one fragment F remains attached to the wall 22.

The fragment F thus remains secured to the wall 22 without any risk of being torn away, which might lead to damage to surrounding components, or to outward expulsion.

Figure 7:
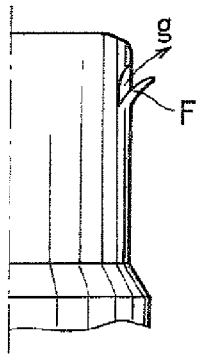
FIG. 7 is a fragmentary side view of said wall and serves to show the deflector function performed by the wall fragment that remains attached to the initiator.

Furthermore, as shown in FIG. 7, depending on the orientation of the fragment(s) F after the zone of weakness has opened, said fragment(s) can act as deflector(s), directing the flow of flame and gas in the manner shown by arrow g.

This can be useful when it is desired for the flow to "lick" the mass of propellant and reach it obliquely, rather than striking it head-on.

Figure 8:
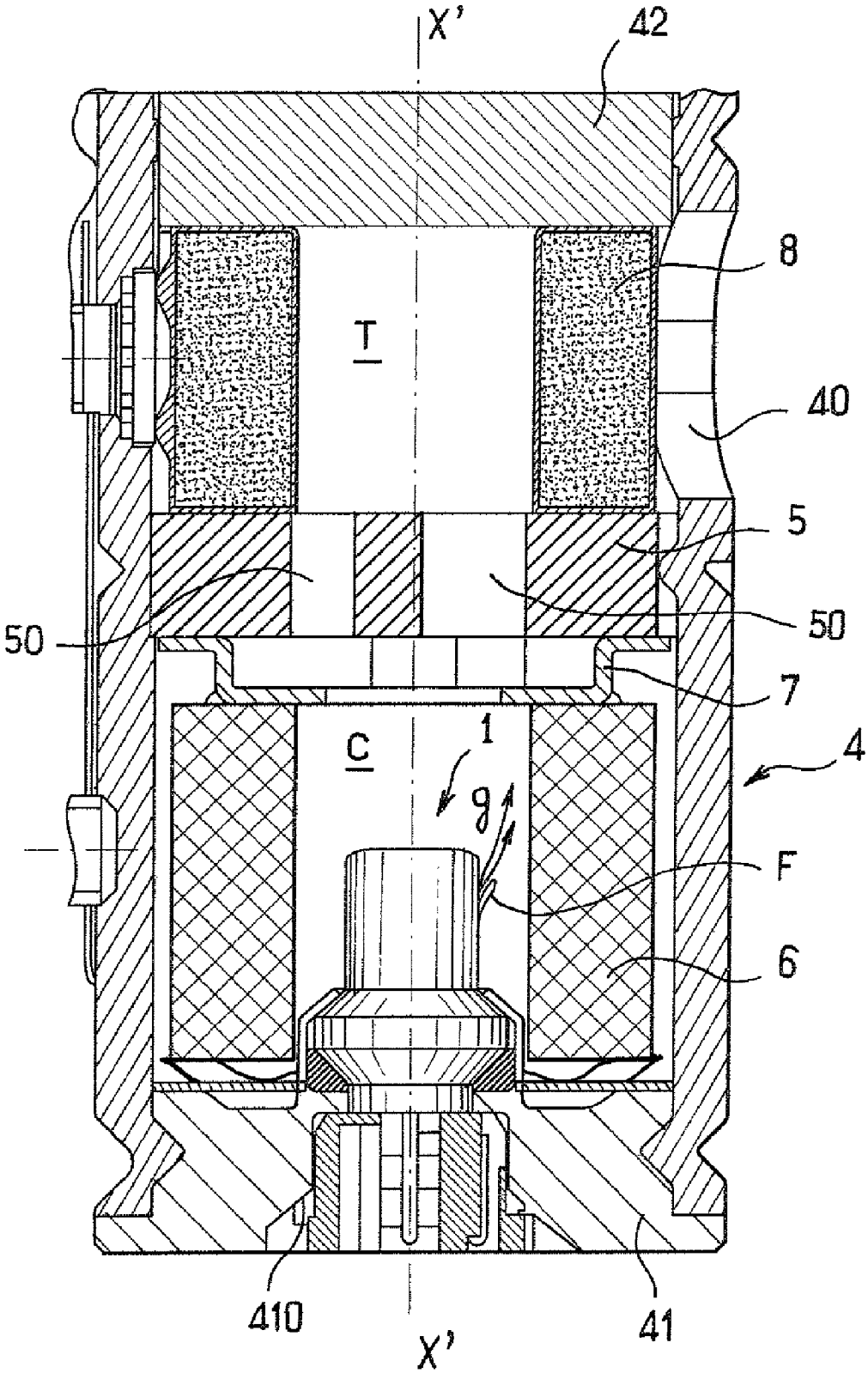
FIG. 8 is a fragmentary view on a longitudinal section plane showing a generator constituting a use for the initiator of the invention.

Accompanying FIG. 8 shows an initiator 1, of the invention included within a gas generator for fitting to a safety device mounted on a motor vehicle.

Said device is preferably a protective airbag or a seatbelt pretensioner.

The generator comprises an enclosure formed by a hollow cylindrical body 4 about an axis X-X' that presents a gas exhaust orifice 40 facing radially.

The opposite ends of the enclosure are closed by crimped-on shutters 41 and 42.

A third transverse partition 5 separates the enclosure into a combustion chamber C and a tranquilizer chamber T.

The partition 5 presents openings 50 which put the two chambers C and T into communication with each other.

The initiator 1 is mounted in an opening 410 centered on the axis X-X' presented by the wall 41. It is fastened thereto and held by appropriate means.

The cap 2 extends completely inside the combustion chamber C.

An electropyrotechnic charge 6, e.g. constituted by propellant, surrounds the initiator. It is annular in shape and its axis of revolution coincides with the axis X-X' of the initiator.

This block is held in place by means of a grid 7 which also bears against the partition 5.

Finally, an outflow condenser 8 of annular shape is held in the tranquilizer chamber T.

In operation, a firing current is applied to the initiator 1 via the pins 11. This ignition then initiates the charge contained in the cap 2.

Because of the increase in pressure therein, the zone 3, 3', or 3" ruptures, thereby allowing gas and flame to exit, as represented by arrows g in FIG. 8.

The fragment F that results from opening the zone of weakness remains attached to the initiator 1 without any risk of it being projected into the combustion chamber C, or even expelled to the outside.

The fragment channels the flame and gas, acting as a deflector. This causes the electropyrotechnic charge 6 to be initiated.

The gas generated thereby penetrates into the chamber T via the openings 50 in the partition, passes through the outflow condenser 8, and leaves via the orifice 40, e.g. for the purpose of inflating an airbag.

Three embodiments of the zone of weakness are described above in the present application. Naturally, other shapes are possible, such as an S-shape or a Z-shape.

Furthermore, the ends of said zone should be far enough apart to ensure that the portion of material between them does not become detached from the wall when the zone of weakness ruptures.

The invention claimed is:

1. An electropyrotechnic initiator for use as a component of a gas generator for an automotive safety device including an airbag or pretensioner, the gas generator having an annular shaped electropyrotechnic charge, the initiator comprising:

an ignition support;

an electrical initiation system connecting the ignition support to a source of electricity; and a cap containing at least one explosive composition, the cap being of a generally cylindrical shape having an open first end connected to the ignition support, and opposite second end that is closed by an end wall, and a peripheral side wall having at least one zone of weakness, the at least one zone of weakness extending along a non-closed trace and over a portion only of the side wall, the non-closed trace shaped such that after a zone of weakness has opened, a fragment of the wall situated between two adjacent ends of the trace remains attached to the wall upon ignition of the explosive composition, and wherein the fragment acts as a deflector to direct gases generated upon the ignition to be directed toward the electropyrotechnic charge when the initiator is disposed inside the charge.

2. The initiator according to claim 1, wherein the trace is at least substantially cruciform.

3. The initiator according to claim 2, wherein the trace is at least substantially in the form of a Saint Andrew's cross.

4. The initiator according to claim 1, wherein the trace has a curved shaped.

5. The initiator according to claim 1, wherein the trace is in the form of a circular arc.

6. The initiator according to claim 1, wherein the trace is at least substantially horseshoe-shaped.

7. The initiator according to claim 1, wherein each zone of weakness includes a thinning of material.

8. The initiator according to claim 1, wherein each zone of weakness is formed by stamping.

* * * * *